United States Patent [19]

Matthe et al.

[11] 4,429,032

[45] Jan. 31, 1984

[54] SURFACE-TREATED VINYL CHLORIDE POLYMER MATERIAL INCLUDING AN ADHERING HYDROPHILIC LAYER

[75] Inventors: Herman L. Matthe, Zoersel; Lucien J. Van Gossum, Kontich; Ludovicus M. Mertens, Halle, all of Belgium

[73] Assignee: Agfa-Gevaert N.V., Mortsel, Belgium

[21] Appl. No.: 376,641

[22] Filed: May 10, 1982

[30] Foreign Application Priority Data

May 18, 1981 [GB] United Kingdom ..... 8115170

[51] Int. Cl.[3] ..... G03C 5/54; G03C 1/48; G03C 1/78; G03C 1/96

[52] U.S. Cl. ..... 430/231; 430/215; 430/227; 430/532; 430/536; 430/539; 430/954; 428/448; 428/451; 428/515; 428/520; 428/522

[58] Field of Search ..... 430/227, 215, 212, 532, 430/536, 539, 954, 534, 533; 428/515, 520, 522, 448, 451; 427/322

[56] References Cited

U.S. PATENT DOCUMENTS

| | | | |
|---|---|---|---|
| T873,009 | 4/1970 | Campbell et al. | 430/532 |
| 2,237,017 | 4/1941 | Thinius | 430/536 |
| 3,214,274 | 10/1965 | Ohyama et al. | 430/536 |
| 3,712,812 | 1/1973 | van Paesschen et al. | 430/532 |

*Primary Examiner*—Richard L. Schilling
*Attorney, Agent, or Firm*—William J. Daniel

[57] ABSTRACT

The adherence of a hydrophilic layer containing a hydrophilic colloid binder upon the surface of a vinyl chloride polymer free of hydrophilic recurring units is improved by exposing the polymer surface to a corona discharge sufficient to satisfy a particular wetting test described in the specification, and colloidal silica is dispersed within the hydrophilic layer in a weight ratio range relative to the binder of 1:5–2:1.

11 Claims, No Drawings

SURFACE-TREATED VINYL CHLORIDE POLYMER MATERIAL INCLUDING AN ADHERING HYDROPHILIC LAYER

This invention relates to surface-treated vinyl chloride polymer material supporting an adhering hydrophilic layer containing a hydrophilic colloid, and which is for example suitable for use in image recording.

Film base materials for use in silver halide photographic materials or silver complex diffusion transfer reversal (DIR) receptor materials are inherently hydrophobic and the usual gelatino-silver halide emulsion layers or colloid layers containing developing nuclei are highly hydrophilic. It is difficult to secure adequate anchorage between the hydrophobic film base and the hydrophilic colloid layer, especially because the anchorage must remain secure throughout all the liquid processing steps the material is subjected to.

Polyester material, e.g. polyethylene terephthalate, has found commercial application as a film base for photographic materials and many techniques for improving the adherence of hydrophilic colloid layers thereto have been proposed. Polyester film material is rather expensive, however, and where the use of cheaper hydrophobic film materials without loss of particularly desired qualities is possible, or special properties, e.g. heat-sealing at moderate temperature, are required, polyvinyl chloride has potential as a film support.

From the U.S. Pat. No. 3,712,812 of August Jean Van Paesschen, Eric Maria Brinckman and Wilfried Florent De Geest, issued Jan. 23, 1973, it is known to improve by a corona-discharge surface treatment the adhesion of a hydrophilic layer to a layer comprising a copolymer formed from 45 to 99.5% by weight of at least one vinylidene chloride or vinyl chloride monomer unit, from 0.5 to 10% by weight of an ethylenically unsaturated hydrophilic monomer unit, and from 0 to 54.5% by weight of at least one other copolymerizable ethylenically unsaturated monomer unit, and which copolymer layer has been applied to a biaxially oriented polyester film.

The presence of the above mentioned hydrophilic monomer unit in the composition of the copolymer layer provides an improved wetting behaviour with respect to hydrophilic colloid layers to be adhered thereto. When such hydrophilic monomer units are absent it becomes very difficult to obtain a sufficient wetting behaviour by corona treatment alone.

It is an object of the present invention to ensure that a corona-discharge surface treated vinyl chloride polymer has the required wettability to provide good adherence in a dry as well as in a wet state to a hydrophilic colloid layer.

The present invention provides a material comprising a vinyl chloride polymer layer and an adhering hydrophilic layer, wherein the adhesivity of the vinyl chloride polymer layer surface to said adhering layer has been improved by a treatment with a corona discharge of the uncoated vinyl chloride polymer layer; characterized in that the adhering layer contains a mixture of a hydrophilic colloid binder and dispersed colloidal silica in a weight ratio of from 5/1 to 1/2, and also that the treatment of the uncoated vinyl chloride polymer with the corona discharge is sufficient to provide a layer surface which is capable of being wetted to a degree determined by a wetting test, which comprises applying to the uncoated vinyl chloride polymer layer surface a test liquid formed of a liquid mixture of formamide and ethylene glycol monomethyl ether in a ratio of at least 90.7:9.3 v/v at a temperature of 20° C. over an area thereof at least 3 cm×3 cm, and the applied test liquid retracts into droplets in a retraction time of at least two seconds.

The test liquid mixture of formamide and ethylene glycol monomethyl ether used in testing the corona discharge-treated vinyl chloride polymer according to the present invention has a liquid-to-air surface tension corresponding to at least 50 milli Newton per meter. When the corona discharge-treated vinyl chloride polymer has achieved the minimum wettability required, the retraction time as hereinbefore set forth is exactly 2 seconds for a liquid of these surface tension values. When the minimum wettability of the vinyl chloride polymer has been exceeded, the retraction time will of course be greater, under the same test conditions.

The liquid-to-air surface tension of mixtures of formamide ethylene glycol monomethyl ether of different volume ratios are set forth in the accompanying table, and if such mixtures were to be applied to the surface treated polymer under the test conditions set forth, the retraction time of exactly 2 seconds would indicate that the treated surface would have a wettability in direct ratio to the set surface tension values. It is to be noted from the table that in order to provide a surface tension of at least 50 mN/m, the liquid mixture used in the test procedure in the present invention has a formamide content of at least 90.7 volume %. Preferably the test fluid has a formamide content of at least 96.5% by volume, corresponding to a liquid-to-air surface tension of at least 54, indicating a correspondingly enhanced wettability generated on the vinyl chloride polymer surface by the corona discharge treatment.

| Formamide % by volume | Ethylene glycol-monomethyl ether % by volume | Surface tension milli Newton per m (mN/m) |
|---|---|---|
| 0.0 | 100.0 | 30 |
| 2.5 | 97.5 | 31 |
| 10.5 | 89.5 | 32 |
| 19.0 | 81.0 | 33 |
| 26.5 | 73.5 | 34 |
| 35.0 | 65.0 | 35 |
| 42.5 | 57.5 | 36 |
| 48.5 | 51.5 | 37 |
| 54.0 | 46.0 | 38 |
| 59.0 | 41.0 | 39 |
| 63.5 | 36.5 | 40 |
| 67.5 | 32.5 | 41 |
| 71.5 | 28.5 | 42 |
| 74.7 | 25.3 | 43 |
| 78.0 | 22.0 | 44 |
| 80.3 | 19.7 | 45 |
| 83.0 | 17.0 | 46 |
| 87.0 | 13.0 | 48 |
| 90.7 | 9.3 | 50 |
| 93.7 | 6.3 | 52 |
| 96.5 | 3.5 | 54 |
| 99.0 | 1.0 | 56 |

The term "vinyl chloride polymer" includes the homopolymer, or any copolymer containing at least 50% by weight of vinyl chloride units and including no hydrophilic recurring units.

Vinyl chloride copolymers may include one or more of the following comonomers: vinylidene chloride, vinyl acetate, acrylonitrile, styrene, butadiene, chloroprene, dichlorobutadiene, vinyl fluoride, vinylidene fluoride, trifluorochloroethylene, and tetrafluoroethylene.

The vinyl chloride polymer may be chlorinated to contain 60–65% by weight of chlorine. Many properties of polyvinyl chloride and its copolymers are improved by plasticization and their stability can be improved by stabilizers well known to those skilled in the art (see, e.g., F. W. Billmeyer, Textbook of Polymer Chemistry, Interscience Publishers, Inc., New York (1957) p. 311–315)).

The vinyl chloride polymer may contain pigments or dyes as colouring matter e.g. in an amount up to 5% by weight. An opaque white appearance may be obtained with e.g. titanium dioxide particles.

The corona-discharge treatment is indispensable as a pre-treatment for achieved reduced hydrophobicity for the polymer surface, but is insufficient to impart strong adherence of a hydrophilic colloid layer in a dry as well as in a wet state to the polyvinyl chloride.

The corona-discharge treatment makes it possible to dispense with a solvent treatment for attacking and roughening the surface of the polyvinyl chloride and is less expensive and more refined in its application.

The corona-discharge may be applied for instance by passing the vinyl chloride polymer, e.g. in sheet or belt form, between an grounded conductive roller and corona wires whereto an alternating current (AC) voltage is applied with sufficiently high potential to cause ionization of the air. Preferably the applied peak voltage is in the range of 10 to 20 kV. An AC corona unit is preferred because it does not need the use of a costly rectifier unit and the voltage level can be easily adapted with a transformer. In corona-discharge treatment with an AC corona unit a frequency range from 10 to 100 kc is particularly suitable. The corona-treatment can be carried out with material in the form of a belt or band at a speed of 10 to 30 m per min while operating the corona unit with a current in the range of 0.4 to 0.6 A over a belt or band width of 25 cm.

The adhering hydrophilic layer contains a mixture of hydrophilic colloid and silica in a ratio by weight of at least 80% with respect to the total weight of the layer.

The colloidal silica present in the hydrophilic colloid layer used in the present invention consists preferably of silica particles having an average particle size in the range of 0.1 to 0.01 μm. Colloidal silica dispersions suited for the purpose of the present invention are commercially available, e.g. as SANTOCEL C (tradename of Monsanto Chemical Company, St. Louis, Mo., U.S.) and as dispersions of hydrated silica, e.g. sold under the trade name LUDOX LS (LUDOX is a trade name of E. I. du Pont de Nemours & Co., Inc., Wilmington, Del., U.S. for a 30% by weight aqueous dispersion of silica) and as SYTON 2X (trade name of Monsanto Chemical Company, St. Louis, Mo., U.S. for a 30% by weight aqueous dispersion of silica particles having an average size of 0.025 μm). The hydrophilic adhering layer containing colloidal silica is applied preferably to the polyvinyl chloride surface in such a way that between 0.14 g and 1.8 g of silica are present per sq.m.

Preferably at least one plasticizer, e.g. in a minor amount of at most 15% by weight with respect to the mixture of hydrophilic colloid and silica, is used for preventing crackling of the silica-containing hydrophilic colloid layer on drying. For that purpose polyols such as hexanetriol and caprolactam have been found to be advantageous. The silica-containing hydrophilic colloid layer may be applied with coating aids, e.g. wetting agents of the type of long carbon chain ($C_{12}$–$C_{20}$) sulphonates and non-ionic compounds of the polyether type, e.g. polyoxyalkylenes.

Drying of the hydrophilic layer proceeds preferably at a temperature not exceeding 80° C., for otherwise serious distortions in the vinyl chloride polymer support may take place which would make it useless as a base for photographic materials.

In addition to the silica well-known matting agents may be incorporated in the hydrophilic colloid layer, e.g. the matting agents described in Product Licensing Index December 1971 p. 108 and in the United Kingdom Patent Specification No. 794,658 filed Feb. 16, 1954 by Gevaert Photo Producten N.V. and in the published European Patent Application No. 0003627 filed Jan. 30, 1979 by Agfa-Gevaert N.V.

The vinyl chloride polymer surface to be treated may be the surface of a sheet or film or may be the surface of any formed item of vinyl chloride polymer, e.g. a bottle or container which is subjected overall to the present surface treatment or only locally, e.g. to improve in a certain spot the adherence for a hydrophilic printing ink or labelling material applied with a hydrophilic glue.

According to a particular embodiment the present invention relates to the use of the corona-discharge surface treated vinyl chloride polymer material with adhering silica-containing hydrophilic colloid layer as part of an image-recording material. For that purpose the hydrophilic colloid layer contains a photographically useful substance or serves as a subbing layer for a hydrophilic colloid layer containing a photographically useful substance.

The photographically useful substance is any material that may serve in a photographic imaging process e.g. a photosensitive substance such as silver halide, a photoradical precursor, and a photosensitive diazo compound, or a non-photosensitive substance useful in photographic imaging or processing e.g. a developing agent, a colour coupler, a dye precursor, a pigment or a dye.

According to a special embodiment the photographically useful substance is development nuclei acting as a catalyst in physical development of silver complex compounds e.g. applied in the diffusion transfer reversal (DTR-) process.

In the preparation of photographic silver halide materials and image-receiving materials for use in DTR-processing, the hydrophilic colloid binder of the present silica-containing hydrophilic colloid layer is preferably gelatin, but other natural and synthetic water-permeable organic colloid binding agents may be used alone or in admixture therewith. Such binding agents include water-permeable polyvinyl alcohol and its derivatives, e.g. partially hydrolyzed polyvinyl acetates, polyvinyl ethers, and acetals, and possibly hydrophilic cellulose ethers and esters, alginic acid and poly-N-vinylpyrrolidinone.

An image-receiving layer containing poly-N-vinylpyrrolidone e.g. in an amount larger than 25% by weight with respect to gelatin has a particularly good affinity for dyes, e.g. anionic dyes so that the entire print may be dyed effectively on processing either by use of at least one dye in the developer or in a solution applied after the development.

The silica-containing hydrophilic colloid layer may be hardened to control its water-permeability and/or to improve its mechanical strength. Hardening agents for proteinaceous hydrophilic colloid layers include, e.g., formaldehyde, glyoxal, mucochloric acid and chrome alum.

The development nuclei used in a hydrophilic colloid binder in a silver complex diffusion transfer reversal (DTR-) image-receiving material are of the kind generally known in the art, e.g. those described in the book: "Photographic silver halide diffusion processes" by André Rott and Edith Weyde—The Focal Press; London and New York (1972) 54–56. Particularly suited are colloidal silver and the sulphides e.g. of silver and nickel and mixed sulphides thereof. The image-receiving material may include in the hydrophilic colloid binder any other additive known for use in such materials, e.g. toning agents, a certain amount of silver halide solvent, one or more developing agents, opacifying agents e.g., pigments, and optical brightening agents.

The present surface-treated polyvinyl chloride material including an adhering silica-containing hydrophilic colloid layer containing developing nuclei is particularly suited for use in identification document production, wherein the photograph and optionally other information is protected against damage, dirt and forgery by lamination of the image receiving material with a plastic cover.

The lamination by heat-sealing proceeds e.g. between flat steel plates under a pressure of 5 to 10 kg/sq.cm at a temperature of 120° C. The polyvinyl chloride support forming an opaque background for the information has usually a thickness of only 0.150 to 0.75 mm so that several sheets of matted polyvinyl chloride are stacked with the sheet containing the information so as to reach the thickness required for a card which for identification has to be inserted in a slot of an electronic identification apparatus.

Examples of such cards are described, e.g. in the U.S. Pat. No. 4,151,666 of Thomas Raphael and Joseph Shulman, issued May 1, 1979. The image-receiving material contains in that case preferably in the polyvinyl chloride support sheet opacifying titanium dioxide and a suitable plasticizing agent. It has a thickness preferably in the range of 0.075 mm to 1 mm and is stacked as described above with other sheets and laminated i.e. heat-sealed to a rigid or semi-rigid transparent plastic cover sheet, also preferably made of polyvinyl chloride but having a lower softening temperature than the sheet carrying the information.

The examples given hereinafter relate especially to the use of the present surface-treated polyvinyl chloride material incorporating in the adhering silica-containing hydrophilic colloid layer developing nuclei which make the material suited for use in a silver complex diffusion transfer reversal process (DTR-process). The material of the present invention is however not limited thereto and can be used wherever a polyvinyl chloride material with an adhering hydrophilic coating is useful or desired.

All parts, ratios and percentages are by weight unless otherwise stated.

EXAMPLE 1

Preparation of comparison material A

A polyvinylchloride sheet having a width of 24 cm and a thickness of 0.150 mm and wetting behaviour corresponding to a surface tension of 38 mN/m (defined analogously with Test T) was treated with an electrical discharge produced by a corona discharge apparatus operated under the following conditions:

film travelling speed: 20 m/min,
electrode spacing to film surface: 2 mm,
corona current: 0.55 A,
AC voltage difference (peak value): 10 kV,
frequency: 30 kc.

After that treatment the wetting behaviour corresponded to a surface tension larger than 56 mN/m.

Thereupon the corona-treated surface was coated with a dispersion of mixed colloidal silver-nickel sulphide nuclei in a 4.5% aqueous gelatin solution to apply such nuclei with respect to the gelatin in a ratio of 0.1%. After drying an image-receiving material suited for use in DTR-processing containing in the development nuclei layer 1.36 g of gelatin per sq.m was obtained.

Preparation of comparison material B

Comparison material B was prepared as comparison material A with the difference, that to the coating composition of the development nuclei layer colloidal silica having an average particle size of 0.025 μm was added, so that the ratio of gelatin to silica was 10/1. The coating composition was applied at a coverage of 1.36 g of gelatin per sq.m.

Preparation of comparison material C

Comparison material C was prepared as comparison material A with the difference, that to the coating composition of the development nuclei layer said colloidal silica was added, so that the ratio of gelatin to silica was 5/1. The coating composition was applied at a coverage of 1.36 g of gelatin per sq.m.

Preparation of comparison material D

Comparison material D was prepared as comparison material A with the difference, that to the coating composition of the development nuclei layer said colloidal silica was added, so that the ratio of gelatin to silica was 2/1. The coating composition was applied at a coverage of 1.36 g of gelatin per sq.m.

Preparation of comparison material E

Comparison material E was prepared as comparison material A with the difference, that to the coating composition of the development nuclei layer said colloidal silica was added, so that the ratio of gelatin to silica was 1/2. The coating composition was applied at a coverage of 0.36 g of gelatin per sq.m. (with the applied coating technique a higher coverage of gelatin was not possible with said ratio of gelatin to silica).

Preparation of comparison material F

Comparison material F was prepared as comparison material A with the difference, that to the coating composition of the development nuclei layer said colloidal silica was added, so that the ratio of gelatin to silica was 1/5. The coating composition was applied at a coverage of 0.36 g of gelatin per sq.m.

In order to check the adhesion between the hydrophilic development nuclei containing layer and the corona-treated polyvinyl chloride support the image receiving materials A to F were subjected to the following tests I and II.

Test I

Adhesion measurement in dry state

On the developing nuclei containing layers of comparison materials A to F an adhesive tape (TESA film 144) was applied under the same pressure and torn off under the same angle at once. (TESA is a registered trade name of Beiersdorf, W. Germany).

The damage to the developing nuclei containing layer which can be determined by visually is a measure for the adherence.

In Table 1 the results of Test I for the materials A to F are given.

Test II

Adhesion measurement in wet state

The comparison materials A to F were soaked in water at room temperature (20° C.) within a same period of time and the wet layer was scratched with a sharp pin to form crossed lines. Adhesion was tested by rubbing these scratches with the finger. The width of broadening of the scratches by the rubbing was a measure for the adhesion in wet state.

In Table 2 the results of Test II for the materials A to F are given.

In Table 3 the quality of a DTR-image obtained on the materials A to F is given.

Table 1

| Material | Quality of adherence in dry state |
|---|---|
| A | very poor |
| B | poor |
| C | fairly good |
| D | good |
| E | very good |
| F | very good |

Table 2

| Material | Quality of adherence in wet state |
|---|---|
| A | very poor |
| B | fairly good |
| C | fairly good |
| D | very good |
| E | very good |
| F | poor |

Table 3

| Material | Quality of DTR-image |
|---|---|
| A | very good |
| B | very good |
| C | very good |
| D | good |
| E | fairly good |
| F | poor |

When the corona-discharge treatment was omitted adherence of the developing nuclei containing layer was in all of the described materials insufficient.

EXAMPLE 2

The preparation of comparison material D of Example 1 was repeated with the difference, however, that the ratio of gelatin to silica was 4/1 and that to the coating composition of the developing nuclei containing layer caprolactam and 1,2,6-hexanetriol were added in an amount of 7% and 3.5% by weight respectively calculated on the mixture of gelatin and silica. Hereby the resistance against crackling of the dried layer was improved.

We claim:

1. A material comprising a vinyl chloride polymer layer free of hydrophilic monomeric units and an adhering hydrophilic layer, wherein the adhesivity of the surface of the vinyl chloride polymer layer to said adhering layer has been improved by a treatment with a corona discharge of the uncoated vinyl chloride polymer layer surface, characterized in that said adhering layer comprises a mixture of a hydrophilic colloid binder and dispersed colloidal silica in a weight ratio of from 5/1 to 1/2, and also that said treatment of the uncoated vinyl chloride polymer layer surface with said corona discharge is sufficient to impart a degree of wettability determined by a wetting test which comprises applying to the treated uncoated vinyl chloride polymer surface a test liquid of a mixture of formamide and ethylene glycol monomethyl ether in a ratio of at least 90.7:9.3 v/v at a temperature of 20° C. over an area thereof at least 3 cm×3 cm, and said applied test liquid mixture retracts into droplets in a retraction time of at least two seconds.

2. Material according to claim 1, characterized in that the corona treatment of the vinyl chloride polymer layer surface imparts a wettability which satisfies said wetting test using a test liquid containing at least 96.5% by volume of formamide.

3. Material according to claim 1, characterized in that the hydrophilic colloid binder of said adhering layer is gelatin.

4. Material according to claim 1, characterized in that the colloidal silica consists of silica particles having an average particle size in the range 0.1 to 0.01 μm.

5. Material according to claim 1, characterized in that in said adhering layer between 0.14 g and 1.8 g of silica are present per sq.m.

6. Material according to claim 1, characterized in that the adhering layer contains the hydrophilic colloid binder in admixture with said colloidal silica in a weight ratio range of about 2/1.

7. Material according to claim 1, characterized in that the adhering layer contains a plasticizer.

8. Material according to claim 1, characterized in that said adhering layer forms part of an image-recording material.

9. Material according to claim 8, characterized in that said adhering layer contains a photographically useful substance or serves as a subbing layer for a hydrophilic colloid layer containing a photographically useful substance.

10. Material according to claim 9, characterized in that said adhering layer contains as photographically useful substances developing nuclei acting as a catalyst in physical development of silver complex compounds.

11. Material according to claim 1, characterized in that the adhering hydrophilic layer contains said mixture of hydrophilic colloid and silica in a ratio by weight of at least 80% with respect to the total weight of said layer.

* * * * *